US010099498B2

(12) United States Patent
Fukunaga et al.

(10) Patent No.: US 10,099,498 B2
(45) Date of Patent: Oct. 16, 2018

(54) THERMAL TRANSFER RECORDING MEDIUM

(71) Applicant: TOPPAN PRINTING CO., LTD., Tokyo (JP)

(72) Inventors: Godai Fukunaga, Tokyo (JP); Seiji Takizawa, Tokyo (JP)

(73) Assignee: Toppan Printing Co., Ltd., Tokyo (JP)

( * ) Notice: Subject to any disclaimer, the term of this patent is extended or adjusted under 35 U.S.C. 154(b) by 0 days.

(21) Appl. No.: 15/639,782

(22) Filed: Jun. 30, 2017

(65) Prior Publication Data

US 2017/0297356 A1 Oct. 19, 2017

Related U.S. Application Data

(63) Continuation of application No. PCT/JP2016/000157, filed on Jan. 14, 2016.

(30) Foreign Application Priority Data

Jan. 28, 2015 (JP) ..... 2015-014464
Feb. 17, 2015 (JP) ..... 2015-028473

(51) Int. Cl.
*B41M 5/42* (2006.01)
*B41M 5/392* (2006.01)
*B41M 5/50* (2006.01)
*B41M 5/44* (2006.01)

(52) U.S. Cl.
CPC ..... *B41M 5/42* (2013.01); *B41M 5/392* (2013.01); *B41M 5/443* (2013.01); *B41M 5/502* (2013.01); *B41M 2205/02* (2013.01); *B41M 2205/38* (2013.01)

(58) Field of Classification Search
CPC ..... B41M 5/38214; B41M 5/42; B41M 5/44; B41M 5/443; B41M 5/446
USPC ..... 503/227
See application file for complete search history.

(56) References Cited

FOREIGN PATENT DOCUMENTS

| | | | |
|---|---|---|---|
| JP | H06-99667 | A | 4/1994 |
| JP | H06-106861 | A | 4/1994 |
| JP | H07-101166 | A | 4/1995 |
| JP | 2007-084670 | A | 4/2007 |
| JP | 2010-083002 | A | 4/2010 |
| JP | 2012-187888 | A | 10/2012 |

(Continued)

OTHER PUBLICATIONS

International Search Report for International Patent Application No. PCT/JP2016/000157 dated Mar. 22, 2016.

*Primary Examiner* — Bruce H Hess
(74) *Attorney, Agent, or Firm* — Foley & Lardner LLP

(57) ABSTRACT

A thermal transfer recording medium that is able to better suppress bleeding or scumming of an image and better suppress the occurrence of peeling lines or abnormal transfer during thermal transfer. The thermal transfer recording medium according to an embodiment includes a heat-resistant slip layer that is formed on one surface of a base material, an undercoat layer that is formed on the other surface of the base material, and a dye layer that is formed on a surface of the undercoat layer that is opposite from the surface that faces the base material; wherein the dye layer includes at least a thermally transferable dye, a first binder resin and a release agent; the release agent includes polyether-modified silicone oil and a perfluoroalkyl compound, and the ratio of the polyether-modified silicone oil and perfluoroalkyl compound, on the basis of a weight ratio, is within the range 9:1 to 6:4.

8 Claims, 1 Drawing Sheet

(56) References Cited

FOREIGN PATENT DOCUMENTS

| | | | |
|---|---|---|---|
| JP | 2013-082212 | A | 5/2013 |
| JP | 2014-210439 | A | 11/2014 |
| JP | 2014-237289 | A | 12/2014 |

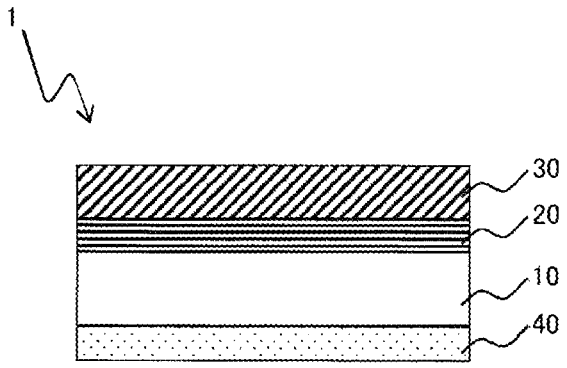
1
30
20
10
40

THERMAL TRANSFER RECORDING MEDIUM

CROSS-REFERENCE TO RELATED PATENT APPLICATIONS

This application is a continuation application filed under 35 U.S.C. § 111(a) claiming the benefit under 35 U.S.C. §§ 120 and 365(c) of International Application No. PCT/JP2016/000157, filed on Jan. 14, 2016, which is based upon and claims the benefit of priority of Japanese Patent Application No. 2015-014464, filed on Jan. 28, 2015, and Japanese Patent Application No. 2015-028473, filed on Feb. 17, 2015, the entireties of which are hereby incorporated by reference.

TECHNICAL FIELD

The present invention relates to a thermal transfer recording medium.

BACKGROUND

Typically, a thermal transfer recording medium is called a thermal ribbon and is an ink ribbon that is used in a thermal transfer type printer and includes a thermal transfer layer that is formed on one surface of a base material, and a heat resistant slip layer (back coat layer) that is formed on the other surface of the base material.

Technology related to a thermal transfer recording medium configured as described above is disclosed, for example, in Patent Literature 1 or Patent Literature 2.

PRIOR ART LITERATURE

Citation List

[Patent Literature 1]

Japanese Patent Application Publication No. JP-A-2007-084670

[Patent Literature 2]

Japanese Patent Application Publication No. JP-A-H07-101166

SUMMARY OF THE INVENTION

Technical Problem

When performing printing using a recent sublimation transfer type high-speed printer that uses a thermal transfer recording medium of conventional technology, a problem of not being able to obtain sufficient printing density, or a problem of peeling lines or abnormal transfer when performing thermal transfer may occur. As a result, when using a thermal transfer recording medium according to conventional technology, a problem may occur in that it may not be possible to sufficiently obtain printed matter having satisfactory quality.

Moreover, even in the case of increasing the amount of release agent added to the dye layer in order to reduce peeling lines and abnormal transfer such as described above, problems may occur in that not only does this not solve the problem of peeling lines and abnormal transfer, but there may also be problems such as bleeding and scumming of images, unsuitable foaming of ink dye, coating problems and the like.

The object of the present invention is to solve such problems by providing a thermal transfer recording medium that is capable of improving or even suppressing bleeding, scumming or the like of images, and that is capable of improving or even suppressing peeling lines and abnormal transfer during thermal transfer.

Solution to Problem

In order to attempt to accomplish the object above, the thermal transfer recording medium of one form of the present invention includes a base material, a heat-resistant slip layer that is formed on one surface of the base material, an undercoat layer that is formed on the other surface of the base material, and a dye layer that is formed on a surface of the undercoat layer that is opposite from the surface that faces the base material; wherein the dye material includes a thermally transferable dye, a first binder resin and a release agent;

the release agent includes polyether-modified silicone oil and a perfluoroalkyl compound; and the ratio of the polyether-modified silicone oil and perfluoroalkyl compound, on the basis of the weight ratio, is within the range 9:1 to 6:4.

Advantageous Effects of the Invention

With the thermal transfer recording medium of one form of the present invention, it is possible to improve or even suppress bleeding or scumming of an image, and to improve or even suppress the occurrence of peeling lines or abnormal transfer during thermal transfer.

BRIEF DESCRIPTION OF THE DRAWINGS

FIG. 1 is a cross-sectional view schematically illustrating the structure of a thermal transfer recording medium of an embodiment of the present invention.

DESCRIPTION OF REPRESENTATIVE EMBODIMENTS

In the detailed explanation below, specific details are described in order to provide a complete understanding of the embodiments of the present invention. However, it is clear that more than one embodiment can be implemented even without those specific details. Also, it is to be understood that the present invention is not necessarily limited to the embodiments set forth herein. The embodiments are representative of the present invention. Moreover, in order to simplify the drawing, well known structure and devices may be schematically illustrated.

In the following, embodiments of the present invention will be explained with reference to the drawing.

(Configuration of a Thermal Transfer Recording Medium)

As illustrated in FIG. 1, the thermal transfer recording medium 1 includes a base material 10, an undercoat layer 20, a dye layer 30, and a heat-resistant slip layer 40. More specifically, the thermal transfer recording medium 1 is configured such that a heat-resistant slip layer 40 that gives lubricity with respect to the thermal head is provided on one surface of the base material 10, and an undercoat layer 20 and dye layer 30 are formed in that order on the other surface of the base material 10.

The thermal transfer recording medium 1 is such that wrinkling occurs easily during printing when deformed due to hot pressing during thermal transfer, so preferably elongation is small when hot pressing is applied. Particularly, it is difficult for wrinkling to occur during printing when the temperature T at which the elongation rate when a sample is heated while being pulled under a 5000 N/m$^2$ load in the MD (Machine Direction) as the elongation direction (mechanical feed direction) becomes 1% is 205° C. or more. The temperature T above is derived by using a TMA/SS6100 manufactured by SII to measure the displacement of a sample that is cooled from room temperature to 0° C. at a rate of −5° C./min and then heated to 260° C. at a rate of 5° C./min.

(Configuration of the Base Material 10)

The base material 10 is required to have thermal resistance and strength so as not to deform under hot pressing during thermal transfer.

Therefore, as the base material 10, it is possible, for example, to use a synthetic resin film such as polyethylene terephthalate, polyethylene naphthalate, polypropylene, cellophane, acetate, polycarbonate, polysulfone, polyimide, polyvinyl alcohol, aromatic polyamide, aramid, polystyrene and the like, and a type of paper such as condenser paper, paraffin paper and the like, alone or in a combination. Among these, when physical properties, processability, cost and the like are taken into consideration, polyethylene terephthalate film is preferred.

Moreover, taking operability and processability into consideration the thickness of the base material 10 can be within a range of no less than 2 μm and no greater than 50 μm. Even within this range, when handling characteristics such as transfer suitability, processability and the like are taken into consideration, a thickness within the range of no less than 2 μm and no greater than 9 μm is preferred.

Moreover, it is also possible to perform bonding treatment on at least one surface of the base material 10 where the heat-resistant slip layer 40 and the undercoat layer 20 are formed. As for this bonding treatment, it is possible, for example, to perform corona treatment, flame treatment, ozone treatment, UV treatment, radiation treatment, roughening treatment, plasma treatment, primer treatment and the like. It is also possible to perform two or more of these treatments in combination.

By performing a bonding treatment above on the base material 10, it is possible to improve the ability to bond the heat-resistant slip layer 40 and undercoat layer 20 to the base material 10.

(Configuration of the Undercoat Layer 20)

The undercoat layer 20 is formed on the other surface (surface on the top side in FIG. 1) of the base material 10.

Moreover, the undercoat layer 20 is formed so as to mainly include a binder having good bonding properties for bonding to both the base material 10 and the dye layer 30.

As the binder that is used in forming the undercoat layer 20, it is possible to use, for example, polyvinylpyrrolidone resin, polyvinyl alcohol type resin, polyester resin, polyurethane resin, polyacrylic resin, polyvinyl formal resin, epoxy resin, polyvinyl butyral resin, polyamide resin, polyether type resin, polystyrene resin, styrene-acrylic copolymer type resin and the like.

The amount of coating of the undercoat layer 20 after drying is not generally limited, however, the amount of solid coating is within the range of being no less than 0.02 g/m$^2$ and no greater than 2.0 g/m$^2$.

This is because disadvantages occur in that when the film thickness of the undercoat layer 20 is thinner than 0.02 g/m$^2$, there is a risk that the transfer sensitivity will decrease, and when the film thickness of the undercoat layer 20 is thicker than 2.0 g/m$^2$, the heat transfer from the thermal head to the dye layer 30 becomes poor, and printing density becomes low.

Here, the coating amount of the undercoat layer 20 after drying refers to the amount of solid content that remains after the coating solution for forming the undercoat layer 20 is applied and dried. Moreover, the coating amount of the dye layer 30 (described later) after drying, and the coating amount of the heat-resistant slip layer 40 after drying, also similarly refer to the amounts of solid content after the respective coating solutions are applied and dried.

As the material for the undercoat layer 20, it is possible to use a known additive such as colloidal inorganic pigment ultrafine particles, an isocyanate compound, silane coupling agent, dispersant, viscosity modifier, stabilizer and the like.

As the colloidal inorganic pigment ultrafine particles, it is possible, for example, to use conventionally known silica (colloidal silica), alumina or alumina hydrate (alumina sol, colloidal alumina, cationic aluminum oxide or hydrate thereof, pseudoboehmite and the like), aluminum silicate, magnesium silicate, magnesium carbonate, magnesium oxide, titanium oxide and the like.

(Configuration of the Dye Layer 30)

The dye layer 30 is formed on the other surface opposite from the surface that faces the base material 10 of the undercoat layer 20 (surface on the top side in FIG. 1).

Moreover, the dye layer 30 is formed, for example, by preparing a coating solution for forming the dye layer 30 by combining thermally transferable dye, binder resin (first binder resin), release agent, solvent and the like, and drying that solution after coating.

The coating amount of the dye layer 30 after drying is suitably about 1.0 g/m$^2$. The dye layer 30 may be configured as a single color and single layer, or can be configured by repeatedly forming plural layers that include dyes having different hues in order on the same surface of the same base material.

The thermally transferable dye that is included in the dye layer 30 is not particularly limited and as long as it can be melted, diffused, and sublimated by heat, the dye can be used. As the yellow component of this thermally transferable dye it is possible to use, for example, solvent yellow 56, 16, 30, 93, 33, disperse yellow 201, 231, 33 and the like. Moreover, as the magenta component it is possible to use, for example, C.I. disperse red 60, C.I. disperse violet 26, C.I. solvent red 27, or C.I. solvent red 19 and the like. As the cyan component it is possible to use, for example, C.I. disperse blue 354, C.I. solvent blue 63, C.I. solvent blue 36, or C.I. disperse blue 24 and the like.

As black dye, it is typical to prepare the color by combining each of the dyes described above.

As the binder resin that is included in the dye layer 30, or in other words the first binder, it is possible to use, for example, a cellulose resin such as ethylcellulose, hydroxyethyl cellulose, ethyl hydroxy cellulose, hydroxypropylcellulose, methylcellulose, cellulose acetate and the like, a vinyl resin such as polyvinyl alcohol, polyvinyl acetate, polyvinyl butyral, polyvinyl acetal, polyvinylpyrrolidone, polyacrylamide and the like, polyester resin, styrene-acrylonitrile copolymer resin, phenoxy resin and the like. However, the binder resin that is included in the dye layer 30 is not particularly limited.

Here, the blending ratio of the dye and binder of the dye layer 30, on the basis of mass, is preferably within the range of (dye)/(binder)=10/100 or greater and 300/100 or less.

This is because when the blending ratio (dye)/(binder) is less than 10/100, there is too little dye and the coloring sensitivity becomes insufficient, and it is not possible to obtain an image having good thermal transfer characteristics. Moreover, when the blending ratio (dye)/(binder) exceeds 300/100, the solubility of the dye with respect to the binder is extremely lowered, the storage stability deteriorates when the thermal transfer recording medium 1 is formed, and the dye precipitates easily.

It is also possible to include, for example, an additive such as an isocyanate compound, a silane coupling agent, a dispersant, a viscosity modifier, a stabilizer and the like in the dye layer 30 to the extent that performance is not impaired.

The release agent that is added to the dye layer 30 includes polyether-modified silicone oil and a perfluoroalkyl compound.

This is because, by adding a release agent that includes polyether-modified silicone oil and a perfluoroalkyl compound to the dye layer 30, it becomes possible to more efficiently suppress fusion of the dye layer 30 and the transfer-receiving body.

Even when the polyether-modified silicone oil and perfluoroalkyl compound are used alone, the effect of preventing fusion of the dye layer 30 and the transfer-receiving body is exhibited, however, in recent sublimation transfer type high-speed printers, peeling lines and abnormal transfer occur during thermal transfer, and satisfactory performance cannot be sufficiently obtained.

Moreover, even when the amount of release agent added is increased, bleeding of the image, scumming, occurrence of foam that is unsuitable for ink dye, existence of release agent inside the dye layer 30 and in the boundary between the undercoat layer 20 and dye layer 30, and printing wrinkles and abnormal transfer due to a decrease in heat resistance occur.

However, by mixing the polyether-modified silicone oil and perfluoroalkyl compound it becomes more possible to localize the release agent component on the surface of the dye layer 30, so even by adding a small amount, it becomes possible to improve or even suppress fusion of the dye layer 30 and the transfer-receiving body.

When comparing the polyether-modified silicone oil and perfluoroalkyl compound, the polyether-modified silicone oil has better ability for preventing fusion of the dye layer 30 and transfer-receiving body.

However, not only is it easy for the release agent to be present on the surface of the dye layer 30, but also inside dye layer 30, so there is a risk that adhesion between the undercoat layer 20 and the dye layer 30 will be reduced.

However, when compared with the polyether-modified silicone oil, the perfluoroalkyl compound is inferior in ability to prevent fusion between the dye layer 30 and the transfer-receiving body, however is easily localized on the surface of the dye layer 30. This is because the surface tension of the perfluoroalkyl group that is included in a fluorine-based release agent is low, and there is a high affinity for air.

In this embodiment, by mixing polyether-modified silicone oil and the perfluoroalkyl compound it becomes possible to localize the release agent on the surface of the dye layer 30 by adding only a small amount.

As the silicone oil it is possible to use polyether-modified polysiloxane, polyether-modified polydimethylsiloxane, polyester-modified polysiloxane, polyester-modified polydimethylsiloxane, aralkyl-modified polymethylalkylsiloxane and the like, however, from the aspect of preventing fusion of the dye layer 30 and transfer-receiving body, polyether-modified silicone is preferred.

Polyether-modified silicone is obtained by introducing polyether as a hydrophilic group into at least one of a side chain and the end of silicone oil (polysiloxane) that is a polymer that includes siloxane bonds. The siloxane chain may have a straight chain shape, a branched shape, or a crosslinked shape.

Typical silicone oil does not dissolve in water and displays water repellency, however, by making it polyether modified, this oil also has excellent compatibility in aqueous and nonaqueous systems, and with only a very small amount, exhibits numerous excellent effects that could not be obtained with conventional organic surfactants.

Moreover, a heterogeneous functional group-modified silicone oil that is obtained by simultaneously introducing an alkyl group, a reactive amino group, an epoxy group or the like can also be used at the same time as a polyether chain according to the material configuration and purpose.

The polyether-modified silicone that is used in this embodiment is commercially available under a generic name, and for example, the following products can be used.

KF-351, KF-352, KF-353, KF-354L, KF-355A, KF-615A, KF-945, KF-640, KF-642, KF-643, KF-644, KF-6020, KF-6204, X-22-4515, KF-6011, KF-6012, KF-6015, KF-6017, KF-6004, X-22-4952, X-22-4272, and KF-6123 manufactured by Shin-Etsu Chemical Co., Ltd. SH8700, SF8410, SH8400, L-7002, FZ-2104, FZ-77, L-7604 and FZ-2203 manufactured by Dow Corning Toray. TSF4440, TSF4441, TSF4445, TSF4450, TSF4446, TSF4452 and TSF4460 manufactured by Momentive Performance Materials Inc. (All of the above are product names.)

Moreover, release agent having a small molecular weight is easily localized on the surface of the dye layer 30, however, there is also a tendency for scumming to occur and dye preservability easily decreases. Therefore, the molecular weight of the polyether-modified silicone oil is preferably 8000 or greater.

It is possible to use a known compound as the perfluoroalkyl compound that is used in this embodiment, and for example, it is possible to use perfluoroalkyl sulfonate, perfluoroalkyl ethylene oxide adduct, perfluoroalkyl trimethyl ammonium salt, perfluoroalkyl aminosulfbonate, perfluoroalkyl group—hydrophilic group containing oligomer, perfluoroalkyl group—lipophilic group containing oligomer, perfluoroalkyl group—(hydrophilic group and lipophilic group) containing oligomer, perfluoroalkyl group—lipophilic group containing urethane, perfluoroalkyl phosphate ester, perfluoroalkyl carboxylate, perfluoroalkylamine compound, perfluoroalkyl quaternary ammonium salt, perfluoroalkyl betaine, non-dissociating perfluoroalkyl compound and the like.

The perfluoroalkyl compound that is used in this embodiment is commercially available under a generic name, and for example, the following products can be used.

As a fluorine-based surfactant it is possible to use Megafac F-470, Megafac F-471, Megafac F-472SF, Megafac F-474, Megafac F471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K and Megafac F-178RM manufactured by DIC Corporation. Surflon S-242, S-243, S-420, S-386, S-611 and S-651 manufactured by AGC Semi Chemical Co., Ltd. Modiper F206, F606 and F3636 manufactured by NOF Corporation. Novec TMFC-4430,and FC-4432 manufactured by Sumitomo 3M. (All of the above are product names.) However, the fluorine-based surfactant is not particularly limited.

The content of the release agent that is blended in the dye layer 30 is preferably within the range of being no less than 0.5% by mass and no greater than 3.0% by mass, and more preferably is within the range of being no less than 1.0% by mass and no greater than 3.0% by mass, when the content of binder resin that is blended in the dye layer 30 is taken to be 100% by mass.

This is because when the content of release agent that is blended in the dye layer 30 is less than 0.5% by mass when the content of binder resin that is blended in the dye layer 30 is taken to be 100% by mass, the absolute amount of release agent is small, so fusion occurs between the dye layer 30 and the transfer-receiving body during printing, and it becomes easy for peeling lines and abnormal transfer to occur.

On the other hand, when the content of release agent that is blended in the dye layer 30 is greater than 3.0% by mass when the content of binder resin that is blended in the dye layer 30 is taken to be 100% by mass , it becomes easy for problems such as scumming, bleeding, abnormal transfer, foaming unsuitable for ink dye, dye precipitation and the like to occur.

Moreover, the mixing ratio of polyether-modified silicone oil and perfluoroalkyl compound, on the basis of mass, is preferably within the range of (polyether-modified silicone oil)/(perfluoroalkyl compound)=9/1 or more and 6/4 or less, and more preferably is within the range of 9/1 or more and 8/2 or less. In other words, the mass ratio of polyether-modified silicone oil and perfluoroalkyl compound is preferably within the range 9:1 to 6:4, and more preferably within the range 9:1 to 8:2.

This is because when the mixing ratio of polyether-modified silicone oil and perfluoroalkyl compound is less than 9/1 (when the perfluoroalkyl compound is reduced), it becomes difficult to localize the release agent on the surface of the dye layer 30, and it becomes easy for fusion of the dye layer 30 and transfer-receiving body to occur.

On the other hand, when the mixing ratio of polyether-modified silicone oil and perfluoroalkyl compound is greater than 6/4, the ratio of polyether-modified silicone oil is reduced, so it becomes easy for fusion of the dye layer 30 and transfer-receiving body to occur.

The dye layer 30 is such that the dye, binder resin, polyether-modified silicone oil and perfluoroalkyl compound described above are essential components, and various additives similar to those conventionally known may be added as necessary.

(Configuration of the Heat-resistant Slip Layer 40)

The heat-resistant slip layer 40 is formed on one surface (surface on the bottom side in FIG. 1) of the base material 10. More specifically, the heat-resistant slip layer 40 is a layer that is formed on one side of the base material 10, and is a layer that provides the thermal transfer recording medium 1 with lubricity with respect to the thermal head. The heat-resistant slip layer 40 of this embodiment preferably has the effect of better suppressing elongation of the thermal transfer recording medium 1 due to hot pressing. The thermal transfer recording medium 1 is such that wrinkling easily occurs during printing when deformed by hot pressing during thermal transfer, so preferably the temperature T, at which the elongation rate becomes 1% in the MD direction when heat is applied to a sample while pulling the sample in the MD direction with a 5000 N/m$^2$ load, is 205° C. or greater, however, in a state in which the dye layer 30 is layered on the undercoat layer 20 on one surface of the base material 10, the temperature above may become less than 205° C. In this case, it is necessary to better suppress deformation of the thermal transfer recording medium 1 due to hot pressing and make it possible for the temperature T of the thermal transfer recording medium to become 205° C. or greater by using a heat-resistant slip layer 40 that deforms only a little due to hot pressing.

The temperature T described above is derived by using a TMA/SS6100 manufactured by SII to measure the displacement that occurs in a sample when cooling the sample from room temperature to 0° C. at a rate of -5° C. /min and then heating the sample to 260° C. at a rate of 5° C./min.

The heat-resistant slip layer 40 is formed, for example, by preparing a coating solution for forming the heat-resistant slip layer 40 by combining binder resin (second binder resin), functional additives that provide releasability and lubricity, a filler, a hardening agent, a solvent and the like, then after applying the coating, allowing the coating to dry.

The coating amount of the heat-resistant slip layer 40 after drying is suitably within the range of no less than 0.1 g/m$^2$ and no more than 2.0 g/m$^2$.

As the binder resin, or in other words the second binder resin, that is included in the heat-resistant slip layer 40 and that is essential for forming a film, it is possible to use, for example, polyvinyl butyral resin, polyvinyl acetoacetal resin, polyester resin, vinyl chloride - vinyl acetate copolymer, polyether resin, polybutadiene resin, acrylic polyol, polyurethane acrylate, polyester acrylate, polyether acrylate, epoxy acrylate, nitrocellulose resin, cellulose acetate resin, polyamide resin, polyimide resin, polyamide imide resin, polycarbonate resin and the like.

Moreover, as the functional additive that is included in the heat-resistant slip layer 40 that provides lubricity to the surface of the heat-resistant slip layer 40 and reduces friction with respect to the printer head it is possible to use, for example, a natural wax such as animal wax, plant wax and the like, a synthetic wax such as synthetic hydrocarbon wax, aliphatic alcohol and acid wax, fatty acid ester and glycerite wax, synthetic ketone wax, amine and amide wax, chlorinated hydrocarbon wax, alpha-olefin wax and the like, a higher fatty acid ester such as butyl stearate, ethyl oleate and the like, a higher fatty acid metal salt such as sodium stearate, zinc stearate, calcium stearate, potassium stearate, magnesium stearate and the like, or a surfactant such as phosphate ester such as a long chain alkyl phosphate ester, polyoxyalkylene alkyl aryl ether phosphate ester, or polyoxylalkylene alkyl ether phosphate ester and the like.

As a filler that is included in the heat-resistant slip layer 40 and that contrary to the functional additive described above, serves the function of providing head cleanability by providing friction with respect to the printer head, it is possible to use, for example, talc, silica, magnesium oxide, zinc oxide, calcium carbonate, magnesium carbonate, kaolin, clay, silicone particles, polyethylene resin particles, polypropylene resin particles, polystyrene resin particles, polymethyl methacrylate resin particles, polyurethane resin particles and the like.

Here, the filler also has the effect of better suppressing elongation of the heat-resistant slip layer 40 during application of hot pressing by filling in between binder resins and preventing the binder resins from coming in contact with each other. Particularly, the particle diameter D50 of the filler is a value that is equal to or greater than the thickness of the heat-resistant slip layer 40, and by being less than 20% by mass with respect to the mass of the heat-resistant slip layer 40, it is possible to obtain a higher suppression effect for suppressing elongation. However, it was found through investigation that when the filler is 20% by mass or greater with respect to the mass of the heat-resistant slip layer 40, the strength of the heat-resistant slip layer 40 film itself decreases and it is not possible to control the elongation with respect to temperature.

Furthermore, as the hardening agent that is included in the heat-resistant slip layer 40 and that provides strength to the heat-resistant slip layer 40, it is possible to use, for example, isocyanates and derivatives thereof such as tolylene diisocyanate, triphenylmethane triisocyanate, tetramethylxylene diisocyanate and the like, however, the hardening agent is not particularly limited.

The embodiment described above is an example of the present invention, and the present invention is not limited by the embodiment described above, and various modifications according to design and the like are possible as long as those modifications are within a range that does not depart from the technical scope of the present invention. Furthermore, the embodiment described above includes inventions in various stages, and various inventions can be extracted by appropriately combining a plurality of disclosed constituent elements. For example, even in the case that some constituent elements are deleted from all of the constituent elements described in the embodiment above, and it is possible to solve the problems described in the section of the problems to be solved by the invention, and the effect described as the effect of the invention can be obtained, the configuration resulting from deleting the constituent elements can be extracted as an invention.

Effect of the Embodiment (1) The thermal transfer recording medium 1 includes a base material 10, a heat-resistant slip layer 40 that is formed on one surface of the base material 10, an undercoat layer 20 that is formed on the other surface of the base material 10, and a dye layer 30 that is formed on the surface of the undercoat layer 20 that is opposite from the surface that faces the base material 10. In addition, the dye layer 30 includes a thermally transferable dye, a first binder resin and a release agent, and the ratio of polyether-modified silicone oil and perfluoroalkyl compound that are included in the release agent is within the range 9:1 to 6:4 according to the weight ratio.

With this kind of configuration, it is possible to provide a thermal transfer recording medium 1 that is capable of improving or even suppressing problems in a coating solution that includes dye for forming a dye layer, in other words, problems such as foaming that is not suitable for ink dye, dye precipitation, image bleeding and scumming and the like, and improving or even suppressing the occurrence of peeling lines and abnormal transfer during thermal transfer.

(2) The content of release agent, when the content of first binder resin is taken to be 100% by mass, may also be within the range of being no less than 0.5% by mass and no greater than 3.0% by mass.

With this kind of configuration, it is possible to provide a thermal transfer recording medium 1 that is capable of improving or even suppressing problems such as foaming that is not suitable for ink dye, dye precipitation, image bleeding and scumming and the like, and improving or even suppressing the occurrence of peeling lines and abnormal transfer during thermal transfer.

(3) The content of release agent, when the content of first binder resin is taken to be 100% by mass, may also be within the range of being no less than 1.0% by mass and no greater than 3.0% by mass.

With this kind of configuration, it is possible to provide a thermal transfer recording medium 1 that is capable of improving or even suppressing problems such as foaming that is not suitable for ink dye, dye precipitation, image bleeding and scumming and the like, and improving or even suppressing the occurrence of peeling lines and abnormal transfer during thermal transfer.

(4) The molecular weight of the polyether-modified silicone oil may also be 8000 or more.

With this kind of configuration, it is possible to provide a thermal transfer recording medium 1 that is capable of effectively improving or even suppressing problems such as foaming that is not suitable for ink dye, dye precipitation, image bleeding and scumming and the like, and effectively improving or even suppressing the occurrence of peeling lines and abnormal transfer during thermal transfer.

(5) The heat-resistant slip layer 40 may include a second binder resin and a filler, the particle diameter D50 of the filler made be a value equal to or greater than the film thickness of the heat-resistant slip layer 40, and the amount of filler added may be less than 20% by mass with respect to the mass of the heat-resistant slip layer 40.

With this kind of configuration, it is possible to provide a thermal transfer recording medium 1 that is capable of improving or even suppressing problems such as foaming that is not suitable for ink dye, dye precipitation, image bleeding and scumming and the like, and improving or even suppressing the occurrence of peeling lines and abnormal transfer during thermal transfer. Moreover, with this kind of configuration, it is difficult for elongation to occur when hot pressing is applied to the heat-resistant slip layer 40, so it is possible to provide a thermal transfer recording medium 1 that is capable of improving or even suppressing the occurrence of printing wrinkles by improving or even suppressing elongation during thermal transfer of the thermal transfer recording medium 1.

(6) The first binder resin and the second binder resin may be the same binder resin.

With this kind of configuration, it is possible to provide a thermal transfer recording medium 1 that is capable of improving or even suppressing problems such as foaming that is not suitable for ink dye, dye precipitation, image bleeding and scumming and the like, and improving or even suppressing the occurrence of peeling lines and abnormal transfer during thermal transfer. Moreover, with this kind of configuration, it is possible to provide a thermal transfer recording medium 1 that is capable of reducing manufacturing costs.

(7) The first binder resin may also be polyvinyl acetal.

With this kind of configuration, it is possible to provide a thermal transfer recording medium 1 that is capable of improving or even suppressing problems such as foaming that is not suitable for ink dye, dye precipitation, image bleeding and scumming and the like, and improving or even suppressing the occurrence of peeling lines and abnormal transfer during thermal transfer.

(8) The temperature T, at which the rate of elongation becomes 1% when a thermal transfer recording medium 1 is heated while being pulled by applying a 5000 $N/m^2$ load in the MD direction of the base material 10, may be 205° C. or more.

With this kind of configuration, it is possible to provide a thermal transfer recording medium 1 that is capable of improving or even suppressing problems such as foaming that is not suitable for ink dye, dye precipitation, image bleeding and scumming and the like, and improving or even suppressing the occurrence of peeling lines and abnormal transfer during thermal transfer. Moreover, with this kind of configuration, it is difficult for elongation to occur when hot pressing is applied to the heat-resistant slip layer 40, so it is possible to provide a thermal transfer recording medium 1 that is capable of improving or even suppressing the occurrence of printing wrinkles by improving or even suppressing elongation during thermal transfer of the thermal transfer recording medium 1.

EXAMPLES

In the following, first examples and second examples of the present invention will be explained, Each of the examples below are only an example of the present invention, and the present invention is not limited by these examples. Moreover, "parts" referred to in the specification, unless stated otherwise, are a reference to mass.

FIRST EXAMPLES

Example 1-1

<Manufacturing of the Base Material 10 on Which the Heat-Resistant Slip Layer 40 is Formed>

Polyethylene terephthalate film having a thickness of 4.5 μm was used as the base material 10, a coating solution for forming the heat-resistant slip layer 40 (coating solution for forming the heat-resistant slip layer 1), having the composition described below, was applied to one surface using a gravure coating method so that the coating amount after drying became 1.0 g/m$^2$, after which the coating was dried for 1 minute at a temperature of 100° C. After that, by performing aging for one week in an environment having a temperature of 40° C., a base material 10 on which a heat-resistant slip layer 40 is formed was obtained.

| <Coating solution for forming a heat-resistant slip layer 1> | |
|---|---|
| Acrylic polyol resin | 12.5 parts |
| Polyosyalkylene alky ether - phosphate ester | 2.5 parts |
| Talc | 6.0 parts |
| 2,6-tolylene diisocyanate prepolymer | 4.0 parts |
| Toluene | 50.0 parts |
| Methyl ethyl ketone | 20.0 parts |
| Ethyl acetate | 5.0 parts |

Next, a coating solution for forming an undercoat layer 20 (coating solution for forming an undercoat layer 1) having the composition described below was applied, by using a gravure coating method, to one of the surfaces of the base material 10 on which the heat-resistant slip layer 40 was not formed so that the coating amount after drying became 0.20 g/m$^2$. After that, the coating was dried for 2 minutes at a temperature of 100° C. to thereby form an undercoat layer 20.

Then, a dye layer 30 was formed on the top of the undercoat layer 20 by using a gravure coating method to apply a coating solution for forming the dye layer 30 (coating solution for forming a dye layer 1-1) so that the coating amount after drying became 0.70 g/m$^2$, and then drying the coating for 1 minute at a temperature of 90° C. In this way, the thermal transfer recording medium 1 of Example 1-1 was obtained.

| <Coating solution for forming an undercoat layer 1> | |
|---|---|
| Polyvinyl alcohol | 2.50 parts |
| Polyvinylpyrrolidone | 2.50 parts |
| Pure water | 57.0 parts |
| Isopropyl alcohol | 38.0 parts |

| <Coating solution for forming a dye layer 1-1> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.054 parts |
| Perfluoroalkyl compound (Megafac F-569: manufactured by DIC Corporation) | 0.006 parts |
| Toluene | 45.00 parts |
| Methyl ethyl ketone | 44.94 parts |

Example 1-2

In Example 1-2, other than forming the dye layer 30 using a coating solution for forming a dye layer 30 (coating solution for forming a dye layer 1-2) having the composition described below, the thermal transfer recording medium 1 of Example 1-2 was obtained under the same conditions as in Example 1-1.

| <Coating solution for forming a dye layer 1-2> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.048 parts |
| Perfluoroalkyl compound (Megafac F-569: manufactured by DIC Corporation) | 0.012 parts |
| Toluene | 45.00 parts |
| Methyl ethyl ketone | 44.94 parts |

Example 1-3

In Example 1-3, other than forming the dye layer 30 using a coating solution for forming a dye layer 30 (coating solution for forming a dye layer 1-3) having the composition described below, the thermal transfer recording medium 1 of Example 1-3 was obtained under the same conditions as in Example 1-1.

| <Coating solution for forming a dye layer 1-3> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.042 parts |
| Perfluoroalkyl compound (Megafac F-569: manufactured by DIC Corporation) | 0.018 parts |
| Toluene | 45.00 parts |
| Methyl ethyl ketone | 44.94 parts |

Example 1-4

In Example 1-4, other than forming the dye layer 30 using a coating solution for forming a dye layer 30 (coating solution for forming a dye layer 1-4) having the composition described below, the thermal transfer recording medium 1 of Example 1-4 was obtained under the same conditions as in Example 1-1.

| <Coating solution for forming a dye layer 1-4> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.036 parts |
| Perfluoroalkyl compound (Megafac F-569: manufactured by DIC Corporation) | 0.024 parts |
| Toluene | 45.00 parts |
| Methyl ethyl ketone | 44.94 parts |

Example 1-5

In Example 1-5, other than forming the dye layer 30 using a coating solution for forming a dye layer 30 (coating solution for forming a dye layer 1-5) having the composition described below, the thermal transfer recording medium 1 of Example 1-5 was obtained under the same conditions as in Example 1-1.

| <Coating solution for forming a dye layer 1-5> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.096 parts |
| Perfluoroalkyl compound (Megafac F-569: manufactured by DIC Corporation) | 0.024 parts |
| Toluene | 45.00 parts |
| Methyl ethyl ketone | 44.88 parts |

Example 1-6

In Example 1-6, other than forming the dye layer 30 using a coating solution for forming a dye layer 30 (coating solution for forming a dye layer 1-6) having the composition described below, the thermal transfer recording medium 1 of Example 1-6 was obtained under the same conditions as in Example 1-1.

| <Coating solution for forming a dye layer 1-6> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.016 parts |
| Perfluoroalkyl compound (Megafac F-569: manufactured by DIC Corporation) | 0.004 parts |
| Toluene | 45.00 parts |
| Methyl ethyl ketone | 44.98 parts |

Example 1-7

In Example 1-7, other than forming the dye layer 30 using a coating solution for forming a dye layer 30 (coating solution for forming a dye layer 1-7) having the composition described below, the thermal transfer recording medium 1 of Example 1-7 was obtained under the same conditions as in Example 1-1.

| <Coating solution for forming a dye layer 1-7> | |
|---|---|
| C.I. solvent blue 63 | 6.0 parts |
| Polyvinyl acetal resin | 4.0 parts |
| Polyether-modified silicone oil (X-22-4957 [molecular weight 5000]; manufactured by Shin-Etsu Chemical Co., Ltd.) | 0.048 parts |
| Perfluoroalkyl compound (Megafac F-569: manufactured by DIC Corporation) | 0.012 parts |
| Toluene | 45.00 parts |
| Methyl ethyl ketone | 44.94 parts |

Comparative Example 1-1

In Comparative Example 1-1, other than forming the dye layer 30 using a coating solution for forming a dye layer 30 (coating solution for forming a dye layer 1-8) having the composition described below, the thermal transfer recording medium 1 of Comparative Example 1-1 was obtained under the same conditions as in Example 1-1.

| <Coating solution for forming a dye layer 1-8> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.12 parts |
| Toluene | 45.00 parts |
| Methyl ethyl ketone | 44.88 parts |

Comparative Example 1-2

In Comparative Example 1-2, other than forming the dye layer 30 using a coating solution for forming a dye layer 30 (coating solution for forming a dye layer 1-9) having the composition described below, the thermal transfer recording medium 1 of Comparative Example 1-2 was obtained under the same conditions as in Example 1-1.

| <Coating solution for forming a dye layer 1-9> | |
|---|---|
| C.I. solvent blue 63 | 6.0 parts |
| Polyvinyl acetal resin | 4.0 parts |
| Polyether-modified silicone oil (X-22-4957 [molecular weight 5000]; manufactured by Shin-Etsu Chemical Co., Ltd.) | 0.12 parts |
| Toluene | 45.00 parts |
| Methyl ethyl ketone | 44.88 parts |

Comparative Example 1-3

In Comparative Example 1-3, other than forming the dye layer 30 using a coating solution for forming a dye layer 30 (coating solution for forming a dye layer 1-10) having the composition described below, the thermal transfer recording medium 1 of Comparative Example 1-3 was obtained under the same conditions as in Example 1-1.

| <Coating solution for forming a dye layer 1-10> | |
|---|---|
| C.I. solvent blue 63 | 6.0 parts |
| Polyvinyl acetal resin | 4.0 parts |

-continued

| <Coating solution for forming a dye layer 1-10> | |
|---|---|
| Polyether-modified silicone oil (X-22-4957 [molecular weight 5000]; manufactured by Shin-Etsu Chemical Co., Ltd.) | 0.28 parts |
| Toluene | 44.86 parts |
| Methyl ethyl ketone | 44.86 parts |

Comparative Example 1-4

In Comparative Example 1-4, other than forming the dye layer 30 using a coating solution for forming a dye layer 30 (coating solution for forming a dye layer 1-11) having the composition described below, the thermal transfer recording medium 1 of Comparative Example 1-4 was obtained under the same conditions as in Example 1-1.

| <Coating solution for forming a dye layer 1-11> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.03 parts |
| Perfluoroalkyl compound (Megafac F-569: manufactured by DIC Corporation) | 0.03 parts |
| Toluene | 45.00 parts |
| Methyl ethyl ketone | 44.88 parts |

Comparative Example 1-5

In Comparative Example 1-5, other than forming the dye layer 30 using a coating solution for forming a dye layer 30 (coating solution for forming a dye layer 1-12) having the composition described below, the thermal transfer recording medium 1 of Comparative Example 1-5 was obtained under the same conditions as in Example 1-1.

| <Coating solution for forming a dye layer 1-12> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.06 parts |
| Perfluoroalkyl compound (Megafac F-569: manufactured by DIC Corporation) | 0.06 parts |
| Toluene | 45.00 parts |
| Methyl ethyl ketone | 44.88 parts |

Comparative Example 1-6

In Comparative Example 1-6, other than forming the dye layer 30 using a coating solution for forming a dye layer 30 (coating solution for forming a dye layer 1-13) having the composition described below, the thermal transfer recording medium 1 of Comparative Example 1-6 was obtained under the same conditions as in Example 1-1.

| <Coating solution for forming a dye layer 1-13> | |
|---|---|
| C.I. solvent blue 63 | 6.0 parts |
| Polyvinyl acetal resin | 4.0 parts |

-continued

| <Coating solution for forming a dye layer 1-13> | |
|---|---|
| Polyether-modified silicone oil (X-22-4272 [molecular weight 10000]; manufactured by Shin-Etsu Chemical Co., Ltd.) | 0.018 parts |
| Perfluoroalkyl compound (Megafac F-569: manufactured by DIC Corporation) | 0.042 parts |
| Toluene | 45.00 parts |
| Methyl ethyl ketone | 44.88 parts |

Comparative Example 1-7

In Comparative Example 1-7, other than forming the dye layer 30 using a coating solution for forming a dye layer 30 (coating solution for forming a dye layer 1-14) having the composition described below, the thermal transfer recording medium 1 of Comparative Example 1-7 was obtained under the same conditions as in Example 1-1.

| <Coating solution for forming a dye layer 1-14> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.036 parts |
| Perfluoroalkyl compound (Megafac F-569: manufactured by DIC Corporation) | 0.084 parts |
| Toluene | 45.00 parts |
| Methyl ethyl ketone | 44.88 parts |

Comparative Example 1-8

In Comparative Example 1-8, other than forming the dye layer 30 using a coating solution for forming a dye layer 30 (coating solution for forming a dye layer 1-15) having the composition described below, the thermal transfer recording medium 1 of Comparative Example 1-8 was obtained under the same conditions as in Example 1-1.

| <Coating solution for forming a dye layer 1-15> | |
|---|---|
| C.I. solvent blue 63 | 6.0 parts |
| Polyvinyl acetal resin | 4.0 parts |
| Perfluoroalkyl compound (Megafac F-569: manufactured by DIC Corporation) | 0.12 parts |
| Toluene | 45.00 parts |
| Methyl ethyl ketone | 44.88 parts |

Comparative Example 1-9

In Comparative Example 1-9, other than forming the dye layer 30 using a coating solution for forming a dye layer 30 (coating solution for forming a dye layer 2-16) having the composition described below, the thermal transfer recording medium 1 of Comparative Example 1-9 was obtained under the same conditions as in Example 1-1.

| <Coating solution for forming a dye layer 1-16> | |
|---|---|
| C.I. solvent blue 63 | 6.0 parts |
| Polyvinyl acetal resin | 4.0 parts |
| Perfluoroalkyl compound | 0.28 parts |

-continued

| <Coating solution for forming a dye layer 1-16> | |
|---|---|
| (Megafac F-569: manufactured by DIC Corporation) | |
| Toluene | 44.86 parts |
| Methyl ethyl ketone | 44.86 parts |

<Manufacturing the Transfer-Receiving Body>

White foamed polyethylene terephthalate film having a thickness of 188 μm was used as the base material, and a coating solution for forming an image-receiving layer (coating solution for forming an image-receiving layer 1) having the composition described below was applied using a gravure coating method to one surface of the base material so that the coating amount after drying became 5.0 g/m$^2$, after which the coating was dried. In this way, the transfer-receiving body for thermal transfer was manufactured.

| <Coating solution for forming an image-receiving layer 1> | |
|---|---|
| Vinyl chloride-vinyl acetate-vinyl alcohol copolymer | 19.5 parts |
| Amino-modified silicone oil | 0.5 parts |
| Toluene | 40.0 parts |
| Methyl ethyl ketone | 40.0 parts |

[Evaluation]

<Bleeding/Scumming Print Evaluation>

Using the transfer-receiving body for thermal transfer, printing was performed by a thermal simulator on the thermal transfer recording mediums 1 that were obtained in Examples 1-1 to 1-7 and Comparative Examples 1-1 to 1-9, and the bleeding and scumming of the printed material were evaluated. The results are given in Table 1.

In Table 1, for evaluating bleeding of the printed material, a natural image (image of a person) was used as the evaluation image. Moreover, in Table 1, for evaluating scumming, a white solid image was used as the evaluation image.

| The printing conditions were as follows: | |
|---|---|
| Printing environment: | 23° C., 50% RH |
| Applied voltage: | 29 V |
| Line cycle: | 0.9 msec |
| Print density: | Main scan: 300 dpi, sub scan: 300 dpi |

Moreover, evaluation of bleeding and scumming of the printed material was performed according to the following criteria.

Criteria of "Δ" or better is a level at which no practical problems occur.

O: No bleeding or scumming can found in the printed material.

Δ: Only a little bleeding or scumming can be found in the printed material.

X: Bleeding or scumming can be found over the entire surface of the printed material.

<Evaluation of Peeling Lines and Abnormal Transfer>

Using a thermal transfer recording medium and transfer-receiving body that have been cured at normal temperature, black gradation printing was performed in an environment having a temperature of 48° C. and humidity of 5% by a thermal simulator on thirty sheets of the thermal transfer recording medium 1 there were obtained in Example 1-1 to 1-7 and Comparative Example 1-1 to 1-9, and whether or not there were peeling lines or abnormal transfer was evaluated. The results are given in Table 1.

The evaluation of peeling lines and abnormal transfer was performed according to the following criteria. Criteria of "Δ" or better is a level at which no practical problems occur. Abnormal transfer having level of "X", means that the dye layer 30 was transferred to the transfer-receiving body, and the evaluation of peeling lines could not be performed, so evaluation was not possible.

O: No peeling lines or abnormal transfer can found in the transfer-receiving body.

Δ: Only a few peeling lines or abnormal transfer can be found in the transfer-receiving body.

ΔX: Peeling lines or abnormal transfer can be partially found in the transfer-receiving body.

X: Peeling lines or abnormal transfer can be found in the entire surface of the transfer-receiving body.

<Measurement of the Surface Si Amount (Si/C)>

In the present invention, by mixing polyether-modified silicone oil and perfluoroalkyl compound, it is possible to localize the release agent component on the surface of the dye layer 30.

In order to confirm that effect, the amount of Si present on the surface of the dye layer 30 was measured, focusing on Si atoms included in the polyether-modified silicone oil. As a result, when there is a large amount of Si present on the surface of the dye layer 30, it means that there is a large amount of polyether-modified silicone oil present on the dye layer 30.

The amount of Si is measured by X-ray photoelectron spectroscopy.

Measurement by X-ray photoelectron spectroscopy quantitatively and qualitatively detects the kinetic energy of specific free electrons that are released from atoms by irradiating the element with X-rays. From this aspect of the measurement theory, this method is a method of measuring elements that make up about 10 nm of the surface from the solid surface, and not a method for measuring the entire thickness direction of the measurement object. Moreover, the amount of Si present on the surface of the dye layer 30 is evaluated using an X-ray photoelectron spectroscopy device (product name "ESCA1600", manufactured by Ulvac-Phi, Inc.).

Moreover, with the X-ray source used taken to be MgKa, and the acceleration voltage of the X-ray source taken to be 15 kV, the amount of release agent present on the surface of the dye layer was quantified by performing qualitative and quantitative measurement of C, Si, N and O among elements having a binding energy within a measurement range of 10 eV or more and 1100 eV or less, and calculating (Si/C) from quantitative values of each element.

The measurement range was about 0.8 mm ϕ. The results are given in Table 1.

In the present invention, both the polyether-modified silicone oil and the perfluoroalkyl compound have releasability from the transfer-receiving body, so the performance aspects such as peeling lines and abnormal transfer cannot be discussed according to only the amount of Si present on the surface of the dye layer 30.

TABLE 1

| | Mixture Ratio (Polyether-modified silicone oil/perfluoroalkyl compound) | Polyether-modified Silicone Oil Molecular Weight | Added Amount | Surface Si Amount (Si/C) | Peeling Lines | Abnormal Transfer | Bleeding | Scumming |
|---|---|---|---|---|---|---|---|---|
| Example 1-1 | 9/1 | 10000 | 1.5 wt % | 0.101 | ○ | ○ | ○ | ○ |
| Example 1-2 | 8/2 | 10000 | 1.5 wt % | 0.095 | ○ | ○ | ○ | ○ |
| Example 1-3 | 7/3 | 10000 | 1.5 wt % | 0.090 | ○ | ○ | ○ | ○ |
| Example 1-4 | 6/4 | 10000 | 1.5 wt % | 0.082 | Δ | ○ | ○ | ○ |
| Example 1-5 | 8/2 | 10000 | 3.0 wt % | 0.135 | ○ | ○ | Δ | Δ |
| Example 1-6 | 8/2 | 10000 | 0.5 wt % | 0.050 | Δ | ○ | ○ | ○ |
| Example 1-7 | 8/2 | 5000 | 1.5 wt % | 0.112 | ○ | ○ | Δ | Δ |
| Comparative Example 1-1 | 10/0 | 10000 | 3.0 wt % | 0.106 | Evaluation not possible | x | ○ | Δ |
| Comparative Example 1-2 | 10/0 | 5000 | 3.0 wt % | 0.121 | Δ | Δ | x | x |
| Comparative Example 1-3 | 10/0 | 10000 | 7.0 wt % | .181 | Evaluation not possible | x | x | x |
| Comparative Example 1-4 | 5/5 | 10000 | 1.5 wt % | 0.065 | Δx | Δ | ○ | ○ |
| Comparative Example 1-5 | 5/5 | 10000 | 3.0 wt % | 0.088 | Δx | ○ | Δ | Δ |
| Comparative Example 1-6 | 3/7 | 10000 | 1.5 wt % | 0.042 | x | ○ | ○ | ○ |
| Comparative Example 1-7 | 3/7 | 10000 | 3.0 wt % | 0.069 | x | ○ | Δ | Δ |
| Comparative Example 1-8 | 0/10 | — | 3.0 wt % | — | x | ○ | Δ | Δ |
| Comparative Example 1-9 | 0/10 | — | 7.0 wt % | — | Δ | ○ | x | x |

<Evaluation Results>

From the results given in Table 1, it was confirmed that in Examples 1-1 to 1-7 in which polyether-modified silicone oil and perfluoroalkyl compound were mixed, peeling lines, bleeding, scumming and abnormal transfer did not occur compared with Comparative Examples 1-1 to 1-3, and 1-8 to 1-9 in which polyether-modified silicone oil and perfluoroalkyl compound were used separately.

Moreover, in Comparative Examples 1-4 and 1-5 in which the mixture ratio of the polyether-modified silicone oil and perfluoroalkyl compound was 5/5, and in Comparative Examples 1-6 and 1-7 in which the mixture ratio was 3/7, the occurrence of peeling lines was confirmed, and it was confirmed that for the mixture ratio of polyether-modified silicone oil and perfluoroalkyl compound, keeping the weight ratio within the range 9:1 to 6:4 is effective.

In Example 1-5 in which the added amount of release agent is 3%, there remained uncertainty about bleeding and scumming, and in Example 1-6 in which the added amount of release agent is 0.5%, there remained uncertainty about the occurrence of peeling lines. From this it was confirmed that the added amount of release agent is preferably within the range of 0.5% or more and 3.0% or less.

Furthermore, it was confirmed from comparing Example 1-2 in which the molecular weight of the polyether-modified silicone oil is 8000 or greater and Example 1-7 in which the molecular weight of the polyether-modified silicone oil is less than 8000, that a larger molecular weight of polyether-modified silicone oil is effective against bleeding and scumming.

Moreover, although a relationship between the amount of Si present on the surface of the dye layer 30 and peeling lines, bleeding, scumming and abnormal transfer could not be determined from comparing the amount of Si present on the surface of the dye layer 30 in Example 1-1 with the amount of Si present on the surface of the dye layer 30 in Comparative Example 1-1, it was confirmed that by mixing with perfluoroalkyl compound, it becomes easier to localize the polyether-modified silicone oil on the surface of the dye layer 30.

SECOND EXAMPLES

Example 2-1

<Manufacturing of the Base Material 10 on Which the Heat-Resistant Slip Layer 40 is Formed>

Polyethylene terephthalate film having a thickness of 4.5 μm was used as the base material 10, a coating solution for forming the heat-resistant slip layer 40 (coating solution for forming the heat-resistant slip layer 2-1), having the composition described below, was applied to one surface using a gravure coating method so that the coating amount after drying became 1.0 g/m$^2$, after which the coating was dried for 1 minute at a temperature of 100° C. After that, by performing aging for one week in an environment having a temperature of 40° C., a base material 10 on which a heat-resistant slip layer 40 is formed was obtained.

| <Coating solution for forming a heat-resistant slip layer 2-1> | |
|---|---|
| Acrylic polyol resin | 15.0 parts |
| Zinc laurate | 3.0 parts |
| Talc (particle diameter (D50) 0.80 μm | 2.2 parts |
| 2,6-tolylene diisocyanate prepolymer | 4.8 parts |
| Toluene | 50.0 parts |
| Methyl ethyl ketone | 20.0 parts |
| Ethyl acetate | 5.0 parts |

Next, a coating solution for forming an undercoat layer 20 (coating solution for forming an undercoat layer 2) having the composition described below was applied, by using a gravure coating method, to one of the surfaces of the base material 10 on which the heat-resistant slip layer 40 was not formed so that the coating amount after drying became 0.20 g/m$^2$. After that, the coating was dried for 2 minutes at a temperature of 100° C. to thereby form an undercoat layer 20.

Then, a dye layer 30 was formed on the top of the undercoat layer 20 by using a gravure coating method to apply a coating solution for forming the dye layer 30 (coating solution for forming a dye layer 2-1) so that the coating amount after drying becomes 0.70 g/m$^2$, and then drying the coating for 1 minute at a temperature of 90° C. In this way, the thermal transfer recording medium 1 of Example 2-1 was obtained.

| <Coating solution for forming an undercoat layer 2> | |
|---|---|
| Polyvinyl alcohol | 2.50 parts |
| Polyvinylpyrrolidone | 2.50 parts |
| Pure water | 57.0 parts |
| Isopropyl alcohol | 38.0 parts |

| <Coating solution for forming a dye layer 2-1> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.054 parts |
| Perfluoroalkyl compound (Megafac F-569: manufactured by DIC Corporation) | 0.006 parts |
| Toluene | 45.00 parts |
| Methyl ethyl ketone | 44.94 parts |

Example 2-2

In Example 2-2, other than forming the dye layer 30 using a coating solution for forming a dye layer 30 (coating solution for forming a dye layer 2-2) having the composition described below, the thermal transfer recording medium 1 of Example 2-2 was obtained under the same conditions as in Example 2-1.

| <Coating solution for forming a dye layer 2-2> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.048 parts |
| Perfluoroalkyl compound (Megafac F-569: manufactured by DIC Corporation) | 0.012 parts |
| Toluene | 45.00 parts |
| Methyl ethyl ketone | 44.94 parts |

Example 2-3

In Example 2-3, other than forming the dye layer 30 using a coating solution for forming a dye layer 30 (coating solution for forming a dye layer 2-3) having the composition described below, the thermal transfer recording medium 1 of Example 2-3 was obtained under the same conditions as in Example 2-1.

| <Coating solution for forming a dye layer 2-3> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.042 parts |
| Perfluoroalkyl compound (Megafac F-569: manufactured by DIC Corporation) | 0.018 parts |

-continued

| <Coating solution for forming a dye layer 2-3> | |
|---|---|
| Toluene | 45.00 parts |
| Methyl ethyl ketone | 44.94 parts |

Example 2-4

In Example 2-4, other than forming the dye layer 30 using a coating solution for forming a dye layer 30 (coating solution for forming a dye layer 2-4) having the composition described below, the thermal transfer recording medium 1 of Example 2-4 was obtained under the same conditions as in Example 2-1.

| <Coating solution for forming a dye layer 2-4> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.036 parts |
| Perfluoroalkyl compound (Megafac F-569: manufactured by DIC Corporation) | 0.024 parts |
| Toluene | 45.00 parts |
| Methyl ethyl ketone | 44.94 parts |

Example 2-5

In Example 2-5, other than forming the dye layer 30 using a coating solution for forming a dye layer 30 (coating solution for forming a dye layer 2-5) having the composition described below, the thermal transfer recording medium 1 of Example 2-5 was obtained under the same conditions as in Example 2-1.

| <Coating solution for forming a dye layer 2-5> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.096 parts |
| Perfluoroalkyl compound (Megafac F-569: manufactured by DIC Corporation) | 0.024 parts |
| Toluene | 45.00 parts |
| Methyl ethyl ketone | 44.88 parts |

Example 2-6

In Example 2-6, other than forming the dye layer 30 using a coating solution for forming a dye layer 30 (coating solution for forming a dye layer 2-6) having the composition described below, the thermal transfer recording medium 1 of Example 2-6 was obtained under the same conditions as in Example 2-1.

| <Coating solution for forming a dye layer 2-6> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.016 parts |

-continued

| <Coating solution for forming a dye layer 2-6> | |
|---|---|
| Perfluoroalkyl compound (Megafac F-569: manufactured by DIC Corporation) | 0.004 parts |
| Toluene | 45.00 parts |
| Methyl ethyl ketone | 44.98 parts |

Example 2-7

In Example 2-7, other than forming the dye layer 30 using a coating solution for forming a dye layer 30 (coating solution for forming a dye layer 2-7) having the composition described below, the thermal transfer recording medium 1 of Example 2-7 was obtained under the same conditions as in Example 2-1.

| <Coating solution for forming a dye layer 2-7> | |
|---|---|
| C.I. solvent blue 63 | 6.0 parts |
| Polyvinyl acetal resin | 4.0 parts |
| Polyether-modified silicone oil (X-22-4957 [molecular weight 5000]; manufactured by Shin-Etsu Chemical Co., Ltd.) | 0.048 parts |
| Perfluoroalkyl compound (Megafac F-569: manufactured by DIC Corporation) | 0.012 parts |
| Toluene | 45.00 parts |
| Methyl ethyl ketone | 44.94 parts |

Example 2-8

In Example 2-8, other than forming a dye layer 30 using coating solution for forming a dye layer 2-5 described above, and forming a heat-resistant slip layer 40 using a coating solution for forming a heat-resistant slip layer 40 (coating solution for forming a heat-resistant slip layer 2-2) having the composition below, the thermal transfer recording medium 1 of Example 2-8 was obtained under the same conditions as in Example 2-1.

| <Coating solution for forming a heat-resistant slip layer 2-2> | |
|---|---|
| Acrylic polyol resin | 16.5 parts |
| Zinc laurate | 3.0 parts |
| Talc (particle diameter (D50) 0.80 μm | 0.2 parts |
| 2,6-tolylene diisocyanate prepolymer | 5.3 parts |
| Toluene | 50.0 parts |
| Methyl ethyl ketone | 20.0 parts |
| Ethyl acetate | 5.0 parts |

Example 2-9

In Example 2-9, other than forming a dye layer 30 using coating solution for forming a dye layer 2-5 described above, and forming a heat-resistant slip layer 40 using a coating solution for forming a heat-resistant slip layer 40 (coating solution for forming a heat-resistant slip layer 2-3) having the composition below, the thermal transfer recording medium 1 of Example 2-9 was obtained under the same conditions as in Example 2-1.

| <Coating solution for forming a heat-resistant slip layer 2-3> | |
|---|---|
| Acrylic polyol resin | 15.8 parts |
| Zinc laurate | 3.0 parts |
| Talc (particle diameter (D50) 0.80 μm | 1.1 parts |
| 2,6-tolylene diisocyanate prepolymer | 5.1 parts |
| Toluene | 50.0 parts |
| Methyl ethyl ketone | 20.0 parts |
| Ethyl acetate | 5.0 parts |

Example 2-10

In Example 2-10, other than forming a dye layer 30 using coating solution for forming a dye layer 2-5 described above, and forming a heat-resistant slip layer 40 using a coating solution for forming a heat-resistant slip layer 40 (coating solution for forming a heat-resistant slip layer 2-4) having the composition below, the thermal transfer recording medium 1 of Example 2-10 was obtained under the same conditions as in Example 2-1.

| <Coating solution for forming a heat-resistant slip layer 2-4> | |
|---|---|
| Acrylic polyol resin | 13.7 parts |
| Zinc laurate | 3.0 parts |
| Talc (particle diameter (D50) 0.80 μm | 4.0 parts |
| 2,6-tolylene diisocyanate prepolymer | 4.0 parts |
| Toluene | 50.0 parts |
| Methyl ethyl ketone | 20.0 parts |
| Ethyl acetate | 5.0 parts |

Comparative Example 2-1

In Comparative Example 2-1, other than forming the dye layer 30 using a coating solution for forming a dye layer 30 (coating solution for forming a dye layer 2-8) having the composition described below, the thermal transfer recording medium 1 of Comparative Example 2-1 was obtained under the same conditions as in Example 2-1.

| <Coating solution for forming a dye layer 2-8> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.12 parts |
| Toluene | 45.00 parts |
| Methyl ethyl ketone | 44.88 parts |

Comparative Example 2-2

In Comparative Example 2-2, other than forming the dye layer 30 using a coating solution for forming a dye layer 30 (coating solution for forming a dye layer 2-9) having the composition described below, the thermal transfer recording medium 1 of Comparative Example 2-2 was obtained under the same conditions as in Example 2-1.

| <Coating solution for forming a dye layer 2-9> | |
|---|---|
| C.I. solvent blue 63 | 6.0 parts |
| Polyvinyl acetal resin | 4.0 parts |

-continued

| <Coating solution for forming a dye layer 2-9> | |
|---|---|
| Polyether-modified silicone oil (X-22-4957 [molecular weight 5000]; manufactured by Shin-Etsu Chemical Co., Ltd.) | 0.12 parts |
| Toluene | 45.00 parts |
| Methyl ethyl ketone | 44.88 parts |

Comparative Example 2-3

In Comparative Example 2-3, other than forming the dye layer 30 using a coating solution for forming a dye layer 30 (coating solution for forming a dye layer 2-10) having the composition described below, the thermal transfer recording medium 1 of Comparative Example 2-3 was obtained under the same conditions as in Example 2-1.

| <Coating solution for forming a dye layer 2-10> | |
|---|---|
| C.I. solvent blue 63 | 6.0 parts |
| Polyvinyl acetal resin | 4.0 parts |
| Polyether-modified silicone oil (X-22-4957 [molecular weight 5000]; manufactured by Shin-Etsu Chemical Co., Ltd.) | 0.28 parts |
| Toluene | 44.86 parts |
| Methyl ethyl ketone | 44.86 parts |

Comparative Example 2-4

In Comparative Example 2-4, other than forming the dye layer 30 using a coating solution for forming a dye layer 30 (coating solution for forming a dye layer 2-11) having the composition described below, the thermal transfer recording medium 1 of Comparative Example 2-4 was obtained under the same conditions as in Example 2-1.

| <Coating solution for forming a dye layer 2-11> | |
|---|---|
| C.I. solvent blue 63 | 6.0 parts |
| Polyvinyl acetal resin | 4.0 parts |
| Perfluoroalkyl compound (Megafac F-569: manufactured by DIC Corporation) | 0.12 parts |
| Toluene | 45.00 parts |
| Methyl ethyl ketone | 44.88 parts |

Comparative Example 2-5

In Comparative Example 2-5, other than forming the dye layer 30 using a coating solution for forming a dye layer 30 (coating solution for forming a dye layer 2-12) having the composition described below, the thermal transfer recording medium 1 of Comparative Example 2-5 was obtained under the same conditions as in Example 2-1.

| <Coating solution for forming a dye layer 2-12> | |
|---|---|
| C.I. solvent blue 63 | 6.0 parts |
| Polyvinyl acetal resin | 4.0 parts |
| Perfluoroalkyl compound (Megafac F-569: manufactured by DIC Corporation) | 0.28 parts |
| Toluene | 44.86 parts |
| Methyl ethyl ketone | 44.86 parts |

Comparative Example 2-6

In Comparative Example 2-6, other than forming the dye layer 30 using a coating solution for forming a dye layer 30 (coating solution for forming a dye layer 2-13) having the composition described below, the thermal transfer recording medium 1 of Comparative Example 2-6 was obtained under the same conditions as in Example 2-1.

| <Coating solution for forming a dye layer 2-13> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.030 parts |
| Perfluoroalkyl compound (Megafac F-569: manufactured by DIC Corporation) | 0.030 parts |
| Toluene | 45.00 parts |
| Methyl ethyl ketone | 44.94 parts |

Comparative Example 2-7

In Comparative Example 2-7, other than forming the dye layer 30 using a coating solution for forming a dye layer 30 (coating solution for forming a dye layer 2-14) having the composition described below, the thermal transfer recording medium 1 of Comparative Example 2-7 was obtained under the same conditions as in Example 2-1.

| <Coating solution for forming a dye layer 2-14> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.060 parts |
| Perfluoroalkyl compound (Megafac F-569: manufactured by DIC Corporation) | 0.060 parts |
| Toluene | 45.00 parts |
| Methyl ethyl ketone | 44.88 parts |

Comparative Example 2-8

In Comparative Example 2-8, other than forming the dye layer 30 using a coating solution for forming a dye layer 30 (coating solution for forming a dye layer 2-15) having the composition described below, the thermal transfer recording medium 1 of Comparative Example 2-8 was obtained under the same conditions as in Example 2-1.

| <Coating solution for forming a dye layer 2-15> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.018 parts |
| Perfluoroalkyl compound (Megafac F-569: manufactured by DIC Corporation) | 0.042 parts |
| Toluene | 45.00 parts |
| Methyl ethyl ketone | 44.94 parts |

Comparative Example 2-9

In Comparative Example 2-9, other than forming the dye layer 30 using a coating solution for forming a dye layer 30

(coating solution for forming a dye layer 2-16) having the composition described below, the thermal transfer recording medium 1 of Comparative Example 2-9 was obtained under the same conditions as in Example 2-1.

| <Coating solution for forming a dye layer 2-16> | |
|---|---|
| C.I. solvent blue 63 | 6.0 parts |
| Polyvinyl acetal resin | 4.0 parts |
| Polyether-modified silicone oil (X-22-4272 [molecular weight 10000]; manufactured by Shin-Etsu Chemical Co., Ltd.) | 0.036 parts |
| Perfluoroalkyl compound (Megafac F-569: manufactured by DIC Corporation) | 0.084 parts |
| Toluene | 45.00 parts |
| Methyl ethyl ketone | 44.88 parts |

Comparative Example 2-10

In Comparative Example 2-10, other than forming a dye layer 30 using coating solution for forming a dye layer 2-5 described above, and forming a heat-resistant slip layer 40 using a coating solution for forming a heat-resistant slip layer 40 (coating solution for forming a heat-resistant slip layer 2-5) having the composition below, the thermal transfer recording medium 1 of Comparative Example 2-10 was obtained under the same conditions as in Example 2-1.

| <Coating solution for forming a heat-resistant slip layer 2-5> | |
|---|---|
| Acrylic polyol resin | 13.0 parts |
| Zinc laurate | 3.0 parts |
| Talc (particle diameter (D50) 0.80 μm | 4.8 parts |
| 2,6-tolylene diisocyanate prepolymer | 4.2 parts |
| Toluene | 50.0 parts |
| Methyl ethyl ketone | 20.0 parts |
| Ethyl acetate | 5.0 parts |

Comparative Example 2-11

In Comparative Example 2-11, other than forming a dye layer 30 using coating solution for forming a dye layer 2-5 described above, and forming a heat-resistant slip layer 40 using a coating solution for forming a heat-resistant slip layer 40 (coating solution for forming a heat-resistant slip layer 2-6) having the composition below, the thermal transfer recording medium 1 of Comparative Example 2-11 was obtained under the same conditions as in Example 2-1.

| <Coating solution for forming a heat-resistant slip layer 2-6> | |
|---|---|
| Acrylic polyol resin | 11.7 parts |
| Zinc laurate | 3.0 parts |
| Talc (particle diameter (D50) 0.80 μm | 6.6 parts |
| 2,6-tolylene diisocyanate prepolymer | 3.7 parts |
| Toluene | 50.0 parts |
| Methyl ethyl ketone | 20.0 parts |
| Ethyl acetate | 5.0 parts |

(Comparative Example 2-12

In Comparative Example 2-12, other than forming a dye layer 30 using coating solution for forming a dye layer 2-5 described above, and forming a heat-resistant slip layer 40 using a coating solution for forming a heat-resistant slip layer 40 (coating solution for forming a heat-resistant slip layer 2-7) having the composition below, the thermal transfer recording medium 1 of Comparative Example 2-12 was obtained under the same conditions as in Example 2-1.

| <Coating solution for forming a heat-resistant slip layer 2-7> | |
|---|---|
| Acrylic polyol resin | 15.0 parts |
| Zinc laurate | 3.0 parts |
| Talc (particle diameter (D50) 0.40 μm | 2.2 parts |
| 2,6-tolylene diisocyanate prepolymer | 4.8 parts |
| Toluene | 50.0 parts |
| Methyl ethyl ketone | 20.0 parts |
| Ethyl acetate | 5.0 parts |

<Manufacturing the Transfer-Receiving Body>

White foamed polyethylene terephthalate film having a thickness of 188 μm was used as the base material, and a coating solution for forming an image-receiving layer (coating solution for forming an image-receiving layer 2) having the composition described below was applied using a gravure coating method to one surface of the base material so that the coating amount after drying became 5.0 g/m$^2$, after which the coating was dried. In this way, the transfer-receiving body for thermal transfer was manufactured.

| <Coating solution for forming an image-receiving layer 2> | |
|---|---|
| Vinyl chloride-vinyl acetate-vinyl alcohol copolymer | 19.5 parts |
| Amino-modified silicone oil | 0.5 parts |
| Toluene | 40.0 parts |
| Methyl ethyl ketone | 40.0 parts |

[Evaluation]

<Bleeding/Scumming Print Evaluation>

Using the transfer-receiving body for thermal transfer, printing was performed by a thermal simulator on the thermal transfer recording mediums 1 that were obtained in Examples 2-1 to 2-10 and Comparative Examples 2-1 to 2-12, and the bleeding and scumming of the printed material was evaluated. The results are given in Table 2.

In Table 2, for evaluating bleeding of the printed material, a natural image (image of a person) was used as the evaluation image. Moreover, in Table 1, for evaluating scumming, a white solid image was used as the evaluation image.

The printing conditions in the second examples are the same as the printing conditions that were explained for the first examples. In the second examples, evaluation of bleeding and scumming of the printed material is the same as the evaluation of bleeding and scumming of the printed materials explained for the first examples. Therefore, a detailed explanation of the printing conditions and evaluation will be omitted here.

<Evaluation of Peeling Lines and Abnormal Transfer>

Using a thermal transfer recording medium and transfer-receiving body that have been cured at normal temperature, black gradation printing was performed in an environment having a temperature of 48° C. and humidity of 5% by a thermal simulator on thirty sheets of the thermal transfer recording mediums 1 that were obtained in Example 2-1 to 2-10 and Comparative Example 2-1 to 2-12, and whether or not there were peeling lines or abnormal transfer was evaluated. The results are given in Table 2.

The evaluation of peeling lines and abnormal transfer in the second examples is the same as the evaluation of the peeling lines and abnormal transfer that were explained for the first examples. Therefore a detailed explanation of the evaluation above will be omitted here.

<Measurement of the Surface Si Amount (Si/C)>

The measurement of the surface Si amount (Si/C) in the second examples is the same as the measurement of the surface Si amount (Si/C) that was explained for the first examples. Therefore a detailed explanation of the evaluation above will be omitted here.

<Measurement of Temperature at Which the Elongation Rate Becomes 1%>

Sheets of the thermal transfer recording mediums 1 that were obtained in Examples 2-1 to 2-10 and Comparative Example 2-1 to 2-12 were heated while being pulled under a load, and the temperature T at which the elongation rate became 1% was measured. The measurement results are given in Table 2.

Moreover, for the configuration of the thermal transfer recording mediums 1 that were obtained in Examples 2-1 to 2-10 and Comparative Examples 2-1 to 2-12, the measurement results for the temperature T for sheets that were manufactured without providing a heat-resistant slip layer 40 are given in Table 2.

Furthermore, the weight ratio of the filler (talc) of the heat-resistant slip layer 40 to the heat-resistant slip layer 40 is also given in Table 2.

The temperature T above was derived by using a TMA/SS6100 manufactured by SII to measure the displacement of a sample that is cooled from room temperature to 0° C. at a rate of −5° C./min while being pulled by applying a 5000 $N/m^2$ load in the MD direction and then heated to 260° C. at a rate of 5° C./min.

<Evaluation of Printing Wrinkles>

Solid printing was performed on the thermal transfer recording mediums 1 that were obtained in Examples 2-1 to 2-10 and Comparative Examples 2-1 to 2-12 using a thermal simulator of which the protective film of the thermal head is SiC, and the printing wrinkles were evaluated. As the evaluation of wrinkles, printing evaluation was performed at a speed of 10 inch/sec for two patterns in which the printing energy was changed between 24 V and 27 V.

Evaluation of defective printing due to wrinkles was performed according to the following criteria: When no wrinkles occurred when a 24 V voltage was applied, there is no practical problem.

O: There was no defective printing in the printed materials due to wrinkles.

X: There was defective printing in the printed materials due to wrinkles.

TABLE 2

| | Coating Solution for Forming a Dye Layer | | | | | | |
|---|---|---|---|---|---|---|---|
| | Mixture ratio | | | | Heat-resistant Slip Layer | | |
| Examples | Silicone type release agent/ fluorine type release agent | Molecular weight of polyether-modified silicone oil | Added amount | Surface Si amount (Si/C) | Particle diameter D50 [μm] of filler | Weight ratio of filler | Peeling lines |
| Example 2-1 | 9/1 | 10000 | 1.5 wt % | 0.101 | 0.80 | 10 wt % | ○ |
| Example 2-2 | 8/2 | 10000 | 1.5 wt % | 0.095 | 0.80 | 10 wt % | ○ |
| Example 2-3 | 7/3 | 10000 | 1.5 wt % | 0.090 | 0.80 | 10 wt % | ○ |
| Example 2-4 | 6/4 | 10000 | 1.5 wt % | 0.082 | 0.80 | 10 wt % | Δ |
| Example 2-5 | 8/2 | 10000 | 3.0 wt % | 0.135 | 0.80 | 10 wt % | ○ |
| Example 2-6 | 8/2 | 10000 | 0.5 wt % | 0.050 | 0.80 | 10 wt % | Δ |
| Example 2-7 | 8/2 | 5000 | 1.5 wt % | 0.112 | 0.80 | 10 wt % | ○ |
| Example 2-8 | 8/2 | 10000 | 3.0 wt % | 0.135 | 0.80 | 1 wt % | ○ |
| Example 2-9 | 8/2 | 10000 | 3.0 wt % | 0.135 | 0.80 | 5 wt % | ○ |
| Example 2-10 | 8/2 | 10000 | 3.0 wt % | 0.135 | 0.80 | 18 wt % | ○ |
| Comparative Example 2-1 | 10/0 | 10000 | 3.0 wt % | 0.106 | 0.80 | 10 wt % | Evaluation not possible |
| Comparative Example 2-2 | 10/0 | 5000 | 3.0 wt % | 0.121 | 0.80 | 10 wt % | Δ |
| Comparative Example 2-3 | 10/0 | 10000 | 7.0 wt % | 0.181 | 0.80 | 10 wt % | Evaluation not possible |
| Comparative Example 2-4 | 0/10 | — | 1.5 wt % | — | 0.80 | 10 wt % | x |
| Comparative Example 2-5 | 0/10 | — | 7.0 wt % | — | 0.80 | 10 wt % | Δ |
| Comparative Example 2-6 | 5/5 | 10000 | 1.5 wt % | 0.065 | 0.80 | 10 wt % | Δx |
| Comparative Example 2-7 | 5/5 | 10000 | 3.0 wt % | 0.088 | 0.80 | 10 wt % | Δx |
| Comparative Example 2-8 | 3/7 | 10000 | 1.5 wt % | 0.042 | 0.80 | 10 wt % | x |
| Comparative Example 2-9 | 3/7 | 10000 | 3.0 wt % | 0.069 | 0.80 | 10 wt % | x |
| Comparative Example 2-10 | 8/2 | 10000 | 3.0 wt % | 0.135 | 0.80 | 22 wt % | ○ |
| Comparative Example 2-11 | 8/2 | 10000 | 3.0 wt % | 0.135 | 0.80 | 30 wt % | ○ |
| Comparative Example 2-12 | 8/2 | 10000 | 3.0 wt % | 0.135 | 0.80 | 10 wt % | ○ |

TABLE 2-continued

| Examples | Abnormal transfer | Bleeding | Scumming | Temperature T at which elongation rate becomes 1% | | Printing wrinkles |
|---|---|---|---|---|---|---|
| | | | | Thermal transfer recording medium | Thermal transfer recording medium with no heat-resistant slip layer | |
| Example 2-1 | ○ | ○ | ○ | 208° C. | 198° C. | ○ |
| Example 2-2 | ○ | ○ | ○ | 208° C. | 198° C. | ○ |
| Example 2-3 | ○ | ○ | ○ | 208° C. | 198° C. | ○ |
| Example 2-4 | ○ | ○ | ○ | 208° C. | 198° C. | ○ |
| Example 2-5 | ○ | Δ | Δ | 205° C. | 195° C. | ○ |
| Example 2-6 | ○ | ○ | ○ | 210° C. | 200° C. | ○ |
| Example 2-7 | ○ | Δ | Δ | 208° C. | 198° C. | ○ |
| Example 2-8 | ○ | Δ | Δ | 205° C. | 195° C. | ○ |
| Example 2-9 | ○ | Δ | Δ | 207° C. | 195° C. | ○ |
| Example 2-10 | ○ | Δ | Δ | 206° C. | 195° C. | ○ |
| Comparative Example 2-1 | x | ○ | ○ | 205° C. | 195° C. | ○ |
| Comparative Example 2-2 | Δ | x | x | 205° C. | 195° C. | ○ |
| Comparative Example 2-3 | x | x | x | 199° C. | 189° C. | x |
| Comparative Example 2-4 | ○ | Δ | Δ | 205° C. | 195° C. | ○ |
| Comparative Example 2-5 | ○ | x | x | 199° C. | 189° C. | x |
| Comparative Example 2-6 | Δ | ○ | ○ | 209° C. | 196° C. | ○ |
| Comparative Example 2-7 | ○ | Δ | Δ | 203° C. | 190° C. | x |
| Comparative Example 2-8 | ○ | ○ | ○ | 209° C. | 196° C. | ○ |
| Comparative Example 2-9 | ○ | Δ | Δ | 207° C. | 194° C. | ○ |
| Comparative Example 2-10 | ○ | Δ | Δ | 203° C. | 195° C. | x |
| Comparative Example 2-11 | ○ | Δ | Δ | 196° C. | 195° C. | x |
| Comparative Example 2-12 | ○ | Δ | Δ | 199° C. | 195° C. | x |

<Evaluation Results>

From the results given in Table 2, it was confirmed that in Examples 2-1 to 1-10 in which polyether-modified silicone oil and perfluoroalkyl compound were mixed, peeling lines, bleeding, scumming and abnormal transfer did not occur compared with Comparative Examples 2-1 to 2-5 in which polyether-modified silicone oil and perfluoroalkyl compound were used separately.

In Example 2-5 in which the added amount of release agent is 3%, there remained uncertainty about bleeding and scumming, and in Example 2-6 in which the added amount of release agent is 0.5%, there remained uncertainty about the occurrence of peeling lines. From this it was confirmed that the added amount of release agent is preferably within the range of 0.5% or more and 3.0% or less.

Furthermore, it was confirmed from comparing Example 2-2 in which the molecular weight of the polyether-modified silicone oil is 8000 or greater and Example 2-7 in which the molecular weight of the polyether-modified silicone oil is less than 8000, that a larger molecular weight of polyether-modified silicone oil is effective against bleeding and scumming.

Moreover, a relationship between the amount of Si present on the surface of the dye layer 30 and peeling lines, bleeding, scumming and abnormal transfer could not be determined, however, from comparing the amount of Si present on the surface of the dye layer 30 in Example 2-1 with the amount of Si present on the surface of the dye layer 30 in Comparative Example 2-1, it was confirmed that by mixing with perfluoroalkyl compound, it becomes easier to localize the polyether-modified silicone oil on the surface of the dye layer 30.

From the results in Table 2, when the temperature at which the elongation rate in the MD direction when a sheet is heated while being pulled under a load in the MD direction of 5000 $N/m^2$ is taken to be temperature T, it was confirmed that in Examples 2-1 to 2-10, and Comparative Examples 2-1, 2-2, 2-4, 2-6, 2-8 and 2-9 in which the temperature of the thermal transfer recording medium 1 was 205° C. or more, printing wrinkles did not occur. However, in Comparative Examples 2-3, 2-5, 2-7 and 2-10 to 2-12 in which the temperature T is less than 205° C., it was confirmed that printing wrinkles did occur. From this it was confirmed that printing wrinkles did not occur when the temperature T is 205° C. or more. This is considered to be because when the temperature T is 205° C. or more, elongation of the thermal transfer recording medium 1 when hot pressing is applied is sufficiently small.

From the results of Examples 2-2, 2-5 and 2-6 in Table 2, the temperature T of the thermal transfer recording medium 1 having no heat-resistant slip layer 40 becomes lower the larger the amount of release agent added to the coating solution for forming a dye layer, and together with this, the temperature T of the thermal transfer recording medium 1 decreases. From this, it is considered that as the added amount of release agent is increased, the elongation rate of the thermal transfer recording medium 1 when hot pressing is applied increases.

Moreover, from the results of Examples 2-5 and 2-8 to 1-10 in Table 2, it was confirmed that when the amount of talc (filler) that is included in the heat-resistant slip layer 40 is 20% by mass or less, the temperature T of the heat-resistant slip layer 40 becomes 205° C. or greater and printing wrinkles do not occur. However, in Comparative Examples 2-10 and 2-11 in which the amount of talc (filler) that is included in the heat-resistant slip layer 40 is 20% by mass or greater, it was confirmed that the temperature T of the heat-resistant slip layer 40 becomes less than 205° C. and printing wrinkles occur. From this, it is confirmed that when the amount of talc (filler) that is included in the heat-resistant slip layer 40 is 20% by mass or less, elongation of the thermal transfer recording medium 1 due to hot pressing is better suppressed and printing wrinkles do not occur, however, when the amount of talc (filler) that is included in the heat-resistant slip layer 40 is 20% by mass or greater, elongation of the thermal transfer recording medium 1 cannot be suppressed completely, and printing wrinkles occur.

From the results of Example 2-5 and Comparative Example 2-12 in Table 2, it was confirmed that when the particle diameter D50 of the filler that is included in the heat-resistant slip layer is equal to or greater than the film thickness (0.60 μm) of the heat-resistant slip layer 40, the effect of better suppressing elongation of the thermal transfer recording medium 1 due to hot pressing as described above appears and printing wrinkles do not occur, however, when the particle diameter D50 of the filler is less than the film thickness (0.60 μm) of the heat-resistant slip layer 40, elongation of the thermal transfer recording medium 1 due to hot pressing cannot be suppressed and printing wrinkles occur.

Here, the present invention was explained while referencing a limited number of embodiments, however, the scope of rights is not limited to these embodiments, and modifications of each embodiment based on the disclosure above are obvious to those skilled in the art.

(Reference Example of the Present Invention)

A thermal transfer recording medium that does not have the technical features of the present invention described above will be briefly explained below as a reference example of the present invention.

Typically, a thermal transfer recording medium is called a thermal ribbon and is an ink ribbon that is used in a thermal transfer type printer, and includes a thermal transfer layer that is formed on one surface of a base material, and a heat-resistant slip layer (back coat layer) that is formed on the other surface of the base material.

Here, the thermal transfer layer is the ink layer, and transfers ink to a transfer-receiving body side by the thermal head of a printer generating heat and sublimating (sublimation transfer method) or melting (melt transfer method) the ink.

At present, even among thermal transfer methods, the sublimation transfer method, together with improving the functionality of a printer, is able to easily form various kinds of images in full color, and so is widely used in self-printing digital cameras, cards such as identification cards and the like, and output material for amusement and the like. Together with the diversification of such uses, there is a demand for compactness, high speed, low cost and durability of the obtained printed materials, and in recent years, a thermal transfer recording medium having plural thermal transfer layers provided on the same side of a base sheet so that a protective layer and that like that provides durability to the printed material does not overlap is becoming rather wide spread.

Under such conditions, with the diversification of uses and spread of popularization, and as the printing speed of printers increases, a problem has occurred in that with a conventional thermal transfer recording medium, sufficient printing density cannot be obtained. Therefore, attempts have been made to improve transfer sensitivity during printing by making the film thickness of the thermal transfer recording medium thinner in order to improve the transfer sensitivity, however, when manufacturing a thermal transfer recording medium or when printing, there are problems in that wrinkles may occur due to heat or pressure, or in some cases breakage may occur.

Moreover, attempts have been made to improve the printing density or the transfer sensitivity during printing by increasing the ratio of dye/resin (dye/binder) in the dye layer of the thermal transfer recording medium, however, not only does the cost increase due to an increase in dye used, but there are also problems in that during winding during the manufacturing process, part of the dye may be transferred (be offset) to the heat-resistant slip layer of the thermal transfer recording medium, and when rewinding after that, the transferred dye may be re-transferred (re-offset) to a dye layer of another color or to a protective layer, and when this dyed layer is thermally transferred to a transfer-receiving body, the hue many be different from the specified color, or in other words, a problem of so-called scumming may occur.

Furthermore, attempts have also been made to increase the energy during image formation on the printer side rather than on the thermal transfer recording medium side, however, not only does power consumption increase, but the life of the thermal head of the printer may be shortened, printing lines may occur due to the dye layer and transfer-receiving body fusing together during printing, and the dye layer and transfer-receiving body not continuously peeling apart, and it may be easy for so-called abnormal transfer to occur in which the dye layer is transferred to the transfer-receiving body.

A method of using a release agent such as a silicone compound or fluorine compound in order to prevent fusion of the dye layer and the transfer-receiving body has been proposed. As such a method, a method of introducing the release agent to the transfer-receiving body side has been proposed, however, in the recent sublimation type thermal transfer recording method, from the aspect of improving protection durability such as scratch resistance, alcohol resistance and light resistance of the printed material, often a transparent resin is laminated as a protective layer to the transfer-receiving body after printing. When doing this, when there is release agent present on the transfer-receiving body, it becomes difficult to transfer the protective layer, which may be disadvantageous for lamination.

As another method, introducing a release agent in the dye layer has also been proposed.

For example, Patent Document 1 discloses that in a dye layer ink that includes a sublimable dye, a binder resin and a release agent, the binder resin is a poly acetal resin, and the release agent is a copolymer of polysiloxane and an acetal resin, and polyether-modified silicone.

Moreover, Patent Document 2 discloses a thermal transfer recording medium that includes a fluorine type surfactant in the dye layer.

INDUSTRIAL APPLICABILITY

The thermal transfer recording medium 1 that is obtained according to the present invention can be used in a sublimation transfer type printer, and together with improving the speed and functionality of a printer, is able to easily form various kinds of images in full color. Therefore, this thermal transfer recording medium 1 can be widely used in self-printing digital cameras, cards such as identification cards and the like, and output material for amusement and the like.

REFERENCE SIGNS LIST

1 Thermal transfer recording medium;
10 Base material;
20 Undercoat layer;
30 Dye layer;
40 Heat-resistant slip layer

What is claimed is:

1. A thermal transfer recording medium comprising:
a base material;
a heat-resistant slip layer that is formed on one surface of the base material;
an undercoat layer that is formed on the other surface of the base material; and
a dye layer that is formed on a surface of the undercoat layer that is opposite from the surface that faces the base material; wherein
the dye layer includes a thermally transferable dye, a first binder resin, and a release agent;
the release agent includes polyether-modified silicone oil and a perfluoroalkyl compound; and
the ratio of the polyether-modified silicone oil and perfluoroalkyl compound, on the basis of a weight ratio, is within the range 9:1 to 6:4.

2. The thermal transfer recording medium of claim 1, wherein the content of the release agent, when the content of the first binder resin is taken to be 100% by mass, is within the range of no less than 0.5% by mass and no greater than 3.0% by mass.

3. The thermal transfer recording medium of claim 1, wherein the content of the release agent, when the content of the first binder resin is taken to be 100% by mass, is within the range of no less than 1.0% by mass and no greater than 3.0% by mass.

4. The thermal transfer recording medium of claim 1, wherein the molecular weight of the polyether-modified silicone oil is 8000 or greater.

5. The thermal transfer recording medium of claim 1, wherein
the heat-resistant slip layer includes a second binder resin and a filler;
the particle diameter D50 of the filler is a value that is equal to or greater than the film thickness of the heat-resistant slip layer; and
the added amount of the filler is less than 20% by mass with respect to the mass of the heat-resistant slip layer.

6. The thermal transfer recording medium of claim 5, wherein the first binder resin and the second binder resin are the same binder resin.

7. The thermal transfer recording medium of claim 1, wherein the first binder resin is polyvinyl acetal.

8. The thermal transfer recording medium of claim 1, wherein when the thermal transfer recording medium is heated while being pulled under a load of 5000 $N/m^2$ in an MD direction that is the direction of elongation of the base material, the temperature at which the elongation rate in the MD direction becomes 1% is 205° C. or greater.

* * * * *